US007796918B2

(12) United States Patent
Watanabe et al.

(10) Patent No.: US 7,796,918 B2
(45) Date of Patent: Sep. 14, 2010

(54) IMAGE FORMING APPARATUS AND ITS CLEANER UNIT, AND CLEANER UNIT REPLACEMENT METHOD OF THE IMAGE FORMING APPARATUS

(75) Inventors: Takeshi Watanabe, Yokohama (JP); Masashi Takahashi, Yokohama (JP); Mitsuaki Kouyama, Higashi-kurume (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 771 days.

(21) Appl. No.: 11/481,385

(22) Filed: Jul. 5, 2006

(65) Prior Publication Data

US 2008/0008498 A1 Jan. 10, 2008

(51) Int. Cl.
*G03G 15/20* (2006.01)

(52) U.S. Cl. ..... 399/123

(58) Field of Classification Search ..... 399/123, 399/353, 354, 358, 360, 71, 98, 99, 102, 399/345

See application file for complete search history.

(56) References Cited

U.S. PATENT DOCUMENTS

| | | | | | |
|---|---|---|---|---|---|
| 4,412,736 | A * | 11/1983 | Sakamoto et al. | 399/354 |
| 4,791,455 | A * | 12/1988 | Yamamoto et al. | 399/345 |
| 5,444,522 | A * | 8/1995 | Owens, Jr. | 399/123 |
| 5,784,674 | A * | 7/1998 | Iseki et al. | 399/297 |
| 5,787,322 | A * | 7/1998 | Sass et al. | 399/110 |
| 6,035,158 | A * | 3/2000 | Asakura et al. | 399/101 |
| 6,549,747 | B2 * | 4/2003 | Brown et al. | 399/353 |
| 6,690,898 | B2 * | 2/2004 | Nishiwaki | 399/101 |
| 6,757,505 | B2 * | 6/2004 | Amemiya et al. | 399/100 |
| 6,963,703 | B2 * | 11/2005 | Hisakuni | 399/71 |
| 2005/0069355 | A1 | 3/2005 | Watanabe et al. | |
| 2006/0222404 | A1 | 10/2006 | Watanabe et al. | |
| 2006/0291903 | A1 | 12/2006 | Watanabe et al. | |
| 2007/0274738 | A1 * | 11/2007 | Watanabe et al. | 399/149 |
| 2008/0002997 | A1 | 1/2008 | Watanabe et al. | |
| 2008/0008489 | A1 | 1/2008 | Watanabe et al. | |

FOREIGN PATENT DOCUMENTS

| | | | |
|---|---|---|---|
| JP | 63137276 | A * | 6/1988 |
| JP | 03141384 | A * | 6/1991 |
| JP | 04318883 | A * | 11/1992 |
| JP | 06-118857 | | 4/1994 |
| JP | 10-031404 | | 2/1998 |
| JP | 2000019861 | A * | 1/2000 |
| JP | 2001343838 | A * | 12/2001 |
| JP | 2004-279681 | | 10/2004 |
| JP | 2005208405 | A * | 8/2005 |

* cited by examiner

*Primary Examiner*—Robert Beatty
(74) *Attorney, Agent, or Firm*—Turocy & Watson, LLP

(57) ABSTRACT

There is provided an image forming apparatus in which occurrence of defective cleaning is prevented, replacement is easy, and occurrence of toner spillage can also be prevented. A cleaner unit of an image forming apparatus of the invention includes a cleaning member that is brought into contact with a toner bearing body in order to collect toner from the toner bearing body bearing the toner, a toner removal member to remove the toner from the cleaning member, and a waste toner storage part to store the removed toner, the cleaning member, the toner removal member and the waste toner storage part are integrally constructed into a unit structure, and the unit is constructed to be attachable to and detachable from the toner bearing body or a main body of the image forming apparatus.

9 Claims, 12 Drawing Sheets

FIG.10

| EXPERIMENT No. | CLEANING MEANS | REMOVAL MEMBER ETC. | PRESENCE/ABSENCE OF OPERATION BEFORE DETACHMENT | CLEANING MEANS APPLICATION BIAS (v) | CONDUCTIVE ROLLER APPLICATION BIAS (v) | TONER SPILLAGE AT TIME OF DETACHMENT | BRUSH STAIN AFTER DETACHMENT (BRUSH SURFACE IS TAPED AND IS ID MEASURED) |
|---|---|---|---|---|---|---|---|
| (1) | BLADE CLEANER | | NO | | | OCCURRENCE | |
| (2) | BRUSH ROLLER | CONDUCTIVE ROLLER + BLADE | NO | | | NO OCCURRENCE | 0.38 |
| (3) | BRUSH ROLLER | CONDUCTIVE ROLLER + BLADE | NON-PRINT OPERATION FOR 15 SECONDS | 500 | 700 | NO OCCURRENCE | 0.3 |
| (4) | BRUSH ROLLER | CONDUCTIVE ROLLER + BLADE | NON-PRINT OPERATION FOR 15 SECONDS | 700 | 1000 | NO OCCURRENCE | 0.2 |
| (5) | BRUSH ROLLER | CONDUCTIVE ROLLER + BLADE | NON-PRINT OPERATION FOR 15 SECONDS | 700 | DC1000v+ACpp1500v 1kHz | NO OCCURRENCE | 0.18 |
| (6) | SPONGE ROLLER | CONDUCTIVE ROLLER + BLADE | NON-PRINT OPERATION FOR 15 SECONDS | 500 | 700 | NO OCCURRENCE | 0.4 |
| (7) | ELASTIC ROLLER (WITH SURFACE LAYER) | BLADE | NO | | | NO OCCURRENCE | 0.3 |
| (8) | ELASTIC ROLLER (WITH SURFACE LAYER) | BLADE | NON-PRINT OPERATION FOR 15 SECONDS | 500 | | NO OCCURRENCE | 0.2 |
| (9) | ELASTIC ROLLER (WITH SURFACE LAYER) | BLADE | NON-PRINT OPERATION FOR 15 SECONDS | 700 | | NO OCCURRENCE | 0.15 |

FIG.11

| CLEANING MEANS | REMOVAL MEMBER ETC. | NUMBER OF SHEETS PRINTED BEFORE OCCURRENCE OF DEFECTIVE CLEANING |
|---|---|---|
| BRUSH ROLLER | CONDUCTIVE ROLLER + BLADE | 100k |
| ELASTIC ROLLER (WITH SURFACE LAYER) | BLADE | 50k |

FIG.13

| COMBINATION 1 | |
|---|---|
| RESPECTIVE PROCESS PARTS | CONTINUOUS PRINTING RESULT |
| CLEANING UNIT (BRUSH IS USED) | DEFECTIVE CLEANING OCCURS AT 100000 SHEETS |
| CHARGING CHARGER | UNEVEN CHARGING NG AT 100000 SHEETS |
| NORMAL DEVELOPING DEVICE | FOGGING NG AT 50000 SHEETS |
| $\phi$30 OPC | PICTURE QUALITY NG AT 40000 SHEETS |
| | REPLACEMENT OPERATION IS REQUIRED AT EVERY 40000 SHEETS |

| COMBINATION 2 | |
|---|---|
| RESPECTIVE PROCESS PARTS | CONTINUOUS PRINTING RESULT |
| CLEANING UNIT (BRUSH IS USED) | DEFECTIVE CLEANING OCCURS AT 100000 SHEETS |
| CHARGING CHARGER | UNEVEN CHARGING NG AT 100000 SHEETS |
| DEVELOPING DEVICE WITH DISCHARGE PORT | NO DETERIORATION IN PICTURE QUALITY EVEN AT 300000 SHEETS |
| $\alpha$-Si PHOTOCONDUCTIVE BODY | NO DETERIORATION IN PICTURE QUALITY EVEN AT 300000 SHEETS |
| | REPLACEMENT OF CLEANING UNIT AND CHARGER IS REQUIRED AT EVERY 100000 SHEETS |

| COMBINATION 3 | |
|---|---|
| RESPECTIVE PROCESS PARTS | CONTINUOUS PRINTING RESULT |
| CLEANING UNIT, CHARGING INTEGRAL UNIT | POOR IMAGE AT 100000 SHEETS = REPLACEMENT |
| DEVELOPING DEVICE WITH DISCHARGE PORT | NO DETERIORATION IN PICTURE QUALITY EVEN AT 300000 SHEETS |
| $\alpha$-Si PHOTOCONDUCTIVE BODY | NO DETERIORATION IN PICTURE QUALITY EVEN AT 300000 SHEETS |
| | ONLY ONE CLEANER AND CHARGING UNIT IS REPLACED AT EVERY 100000 SHEETS |

| COMBINATION 4 | |
|---|---|
| RESPECTIVE PROCESS PARTS | CONTINUOUS PRINTING RESULT |
| CLEANING UNIT (CHANGED TO RESIN) | DEFECTIVE CLEANING OCCURS AT 80000 SHEETS |
| CHARGING CHARGER | UNEVEN CHARGING NG AT 100000 SHEETS |
| DEVELOPING DEVICE WITH DISCHARGE PORT | NO DETERIORATION IN PICTURE QUALITY EVEN AT 300000 SHEETS |
| $\alpha$-Si PHOTOCONDUCTIVE BODY | NO DETERIORATION IN PICTURE QUALITY EVEN AT 300000 SHEETS |
| | LIFE OF CLEANING UNIT IS SLIGHTLY LOWERED |

IMAGE FORMING APPARATUS AND ITS CLEANER UNIT, AND CLEANER UNIT REPLACEMENT METHOD OF THE IMAGE FORMING APPARATUS

BACKGROUND OF THE INVENTION

1. Field of the Invention

The present invention relates to an image forming apparatus using an electrophotographic system and its cleaner unit, and a cleaner unit replacement method of the image forming apparatus.

2. Description of the Related Art

At present, in an image forming apparatus using an electrophotographic system, a so-called cartridge system is widely known in which a photoconductive body, a charger, and a cleaner are integrally constructed into a unit, and it is replaced as a structure attachable to and detachable from the image forming apparatus. This cartridge often integrally includes a developing device as well, and further, there is also an example in which all parts, including a toner tank and a waste toner tank, are integrated. The merits of the cartridge system as stated above are that the maintenance can be easily performed by the user and by merely replacing the single unit, it is not necessary that a serviceman or the like makes a business trip and makes a replacement, and further, when the apparatus is stopped due to failure caused by the unit, since it can be easily returned by merely replacing the unit, down time can be reduced.

However, there is a problem in the cartridge system as stated above. Since the whole unit is collectively replaced, a part which has not reached the replacement cycle is also replaced. For example, in the case of a cartridge in which a photoconductive body, a charger and a cleaner are integrally constructed, when the cleaner is worn down, even if the photoconductive body is still in a usable state, both are replaced, and consequently, the cost of consumables is increased.

Further, in recent years, the replacement cycle of the photoconductive body becomes long by the emergence of the photoconductive body using A-Si (Amorphous Silicon), or the organic photoconductive body in which the surface layer having high hardness is provided on its surface. On the other hand, with respect to the cleaner part, the structure of the cleaner itself must be complicated in order to prolong the life, and in association with this, the cleaner part becomes large, and it is difficult to apply the cleaner part to a small diameter photoconductive body.

Then, in patent document 1 (JP-A-6-118857) and patent document 2 (JP-A-10-31404), there is proposed a method in which a cleaner part is constructed to be attachable to and detachable from a photoconductive body, and the user can easily replace the cleaner part.

This is such that blade cleaning means is constructed to be attachable to and detachable from the photoconductive body, and at that time, toner spillage from a cleaner opening at the time of detachment, which is a problem, is prevented. Specifically, the opening of the blade cleaner portion of the cleaner unit is covered with a sheet-like member, and since the opening itself is closed by this, the toner spillage is greatly reduced.

However, in the related art, after all, the blade cleaner has a large opening, and it is strictly difficult to cover the opening with the sheet at the same time as the detachment from the photoconductive body, and it can not be avoided that the toner spillage occurs although the amount is slight.

Besides, in the blade cleaner, contact accuracy to the photoconductive body is delicate, a slight shift causes defective cleaning, and it is difficult to form an easily replaceable structure.

SUMMARY OF THE INVENTION

The invention has been made to solve the foregoing problem, and it is an object to provide a cleaner unit of an image forming apparatus in which occurrence of defective cleaning is prevented, replacement is easy, and occurrence of toner spillage can also be prevented, an image forming apparatus using the same, and a replacement method of the cleaner unit of the image forming apparatus.

In order to solve the problem, a cleaner unit of an image forming apparatus according to an aspect of the invention includes a cleaning member that is brought into contact with a toner bearing body in order to collect toner from the toner bearing body bearing the toner, a toner removal member configured to remove the toner from the cleaning member, and a waste toner storage part configured to store the removed toner, the cleaning member, the toner removal member and the waste toner storage part are integrally constructed into a unit structure, and the unit is characterized in that it is constructed to be attachable to and detachable from the toner bearing body or a main body of the image forming apparatus.

Besides, a cleaner unit of an image forming apparatus according to an aspect of the invention includes cleaning means brought into contact with toner bearing means and for collecting toner from the toner bearing means bearing the toner, toner removal means for removing the toner from the cleaning means, and waste toner storage means for storing the removed toner, the cleaning means, the toner removal means and the waste toner storage means are integrally constructed into a unit structure, and the unit is characterized in that it is constructed to be attachable to and detachable from the toner bearing means or a main body of the image forming apparatus.

Besides, an image forming apparatus according to an aspect of the invention includes a toner bearing body configured to bear toner, a cleaning member that is brought into contact with the toner bearing body in order to collect the toner from the toner bearing body, a toner removal member configured to remove the toner from the cleaning member, and a waste toner storage part configured to store the removed toner, the cleaning member, the toner removal member and the waste toner storage part are integrally constructed into a unit structure, and the unit is characterized in that it is constructed to be attachable to and detachable from the toner bearing body or a main body of the image forming apparatus.

Besides, a cleaner replacement method of an image forming apparatus according to an aspect of the invention includes making a unit including a cleaning member that is brought into contact with a toner bearing body in order to collect toner from the toner bearing body, a toner removal member to remove the toner from the cleaning member, and a waste toner storage part to store the removed toner, making the unit attachable to and detachable from a main body of the image forming apparatus, actuating a toner leakage preventing mechanism to prevent toner leakage when the unit is detached from the image forming apparatus, moving the toner to the toner bearing body or a side of the waste toner storage part, and detaching the unit from the main body of the image forming apparatus.

DESCRIPTION OF THE DRAWINGS

FIG. 1(*b*) is a schematic side view showing a modified example of FIG. 1(*a*).

FIG. 2(*b*) is a schematic view for explaining a process unit which is attachable to and detachable from a main body of an apparatus.

FIG. 6(*b*) is side view of the developing device shown in FIG. 6(*a*).

FIG. 10 is a view showing evaluation of toner stain at a time when a cleaner unit is detached.

FIG. 11 is a view showing durability evaluation results.

FIG. 13 is a table showing a maintenance cycle by a combination of respective processes.

DESCRIPTION OF THE EMBODIMENTS

Hereinafter, embodiments of the invention will be described with reference to the drawings.

Figure 1:
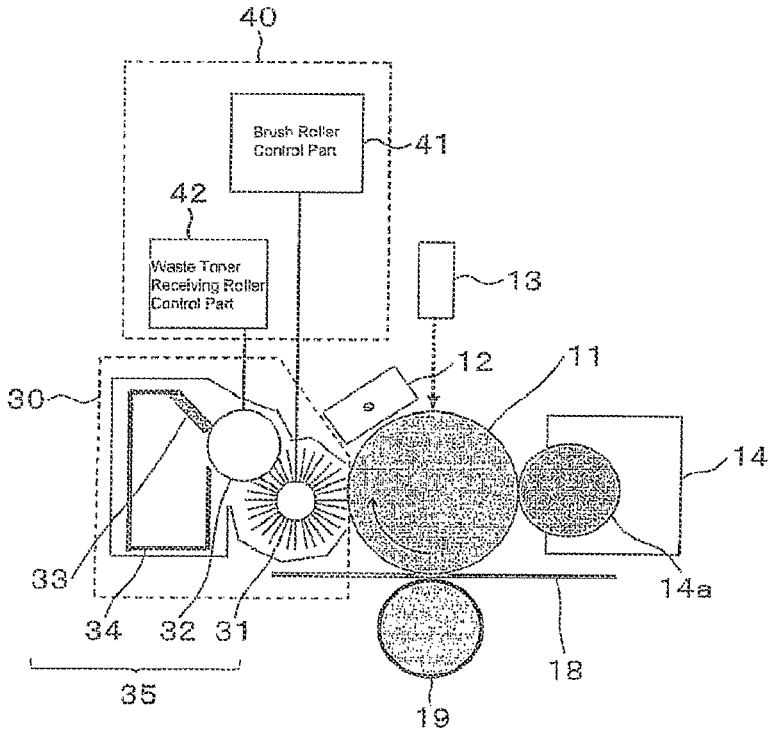
FIG. 1(*a*) is a schematic side view showing an example of an embodiment of the invention.
Figure 1:
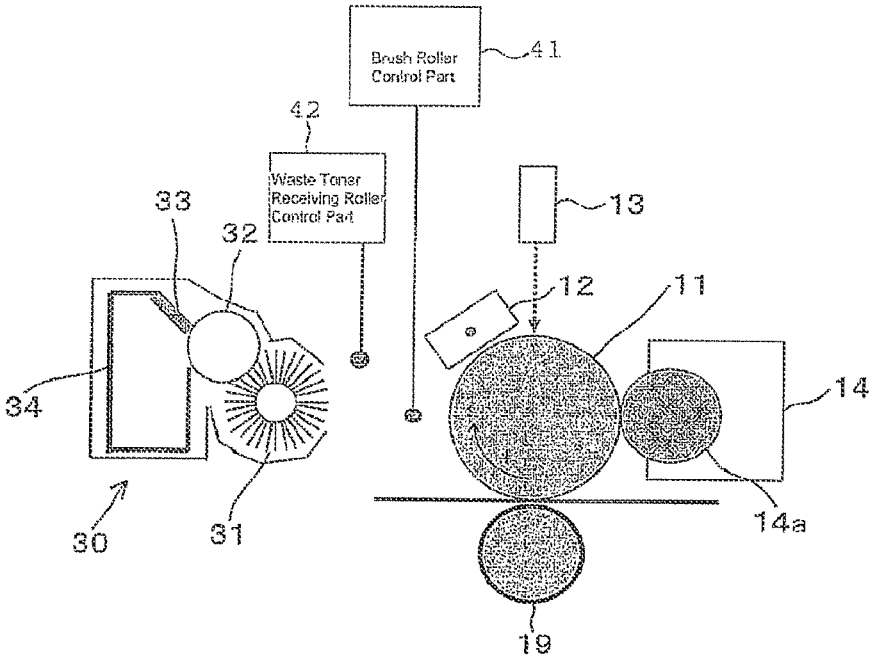

FIG. 1(*a*) is a schematic view showing an image forming apparatus using an electrophotographic system as an embodiment of the invention.

This image forming apparatus includes a photoconductive body 11, a charger 12, an exposure device 13, a developing part 14, a cleaner 30 and a cleaner control part 40, which are arranged around the photoconductive body 11.

The cleaner 30 includes a cleaning part 35 and a waste toner box (equivalent to a waste toner storage part, waste toner storage means) 34 to receive and contain waste toner, and constitutes a cleaner unit.

The cleaning part 35 includes a brush roller (equivalent to a cleaning member, cleaning means) 31 to clean the photoconductive body 11, a waste toner receiving roller (equivalent to a toner removal member, toner removal means) 32 to receive the waste toner from the brush roller 31, and a cleaning blade (toner removal member, toner removal means) 33 to scrape the waste toner received by the waste toner receiving roller 32.

The cleaner control unit 40 includes a brush roller control part 41 to control the brush roller 31, and a waste toner receiving roller control part 42 to control the waste toner receiving roller 32.

The photoconductive body 11 is such that an organic or amorphous silicon photoconductive layer is provided on a conductive board and constitutes an image bearing body (toner bearing body). Here, a description will be made while, as the photoconductive body 11, an organic photoconductive body charged with minus polarity is used as an example.

The photoconductive body 11 is uniformly charged to, for example, −500 v by the charger 12 such as a well-known roller charger, corona charger, or scorotron charger, and then is subjected to exposure by the exposure device 13 with an image-modulated laser beam or LED, and an electrostatic latent image is formed on the surface. At this time, the potential of the surface of the exposed photoconductive body is, for example, about −80 v.

Thereafter, the electrostatic latent image is visualized by the developing device 14. In the developing device 14, for example, in accordance with a two-component developing system in which a non-magnetic toner negatively charged and a magnetic carrier are mixed, carrier beads are formed on a developing roller 14*a* provided with a magnet, and about −200 to −400 v is applied to the developing roller 14*a* so that the toner is attached to the exposed part of the surface of the photoconductive body 11, and is not attached to the non-exposed part. The developing device 14 may adopt a one-component developing system in which carrier is not used, and development is performed only by toner.

Further, the toner image of the photoconductive body 11 is transferred onto a sheet or an intermediate transfer body as a transfer-receiving member 18, and the supply of electric field at that time is performed by a transfer roller 19 brought into contact with the back of the transfer-receiving member 18, or the corona charger. Besides, when the transfer-receiving member 18 is an intermediate transfer belt, it is performed by a transfer member brought into contact with the back of the belt, such as a transfer roller, a transfer blade, or a transfer brush. A voltage applied to the transfer member is about plus 300 to 2 kv.

The residual toner remaining on the photoconductive body 11 after transfer is removed by the cleaner 30, and then, the photoconductive body is subjected to a charge removal process when necessary, is again subjected to the charging process, and proceeds to an image forming process of a next rotation.

Hereinafter, although a residual toner process in the embodiment of the invention will be described, before that, an example of a waste toner process in the related art will be described by use of FIG. 2 for reference. Incidentally, in FIG. 2, same symbols as those of FIG. 1 denote the same objects or equivalents.

Figure 2B:
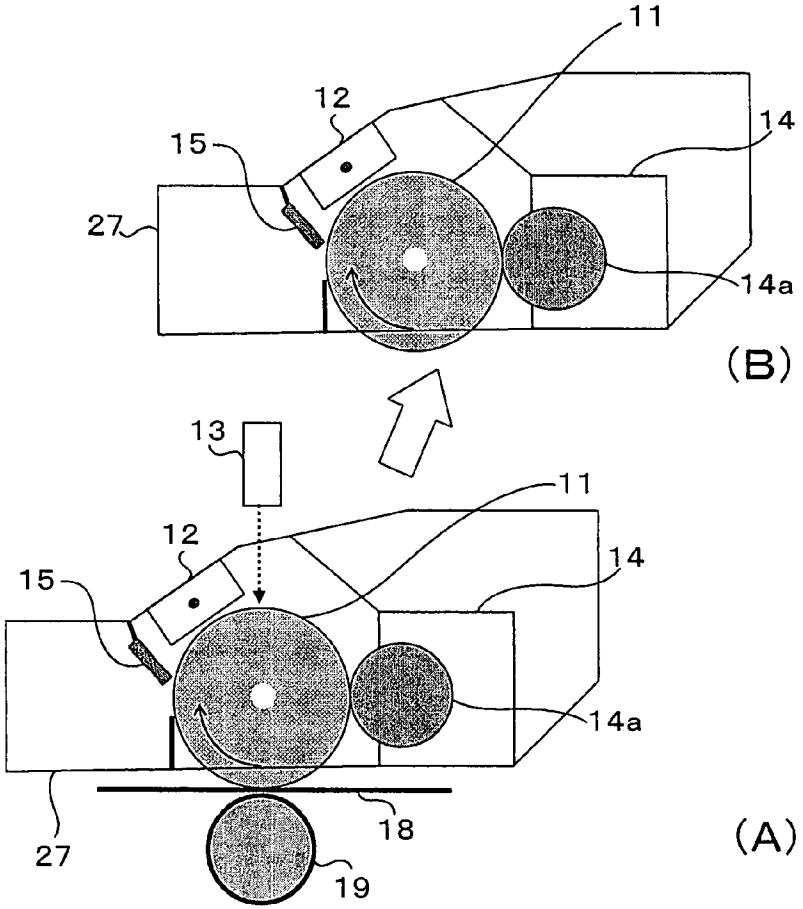
FIG. 2(*a*) is a schematic side view showing a related art corresponding to FIG. 1(*a*).
Figure 2A:
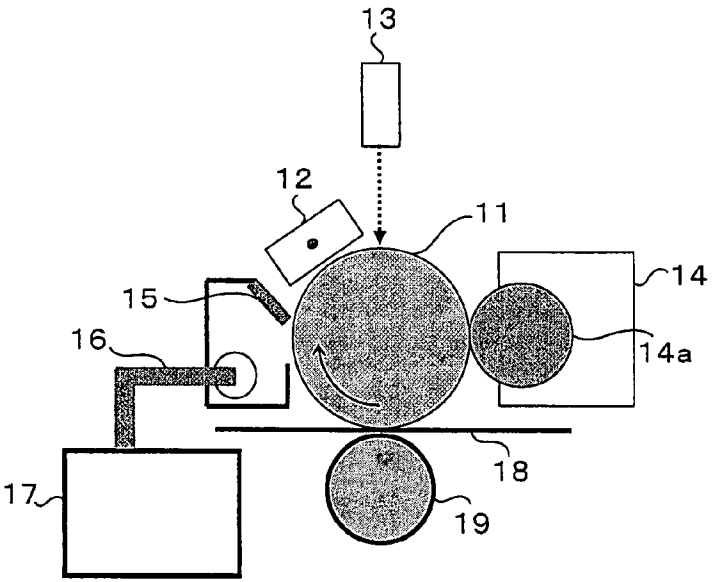

As shown in FIG. 2(*a*), in many cases, waste toner removed by a cleaning blade 15 is sent to a waste toner box through a dedicated transport passage. Besides, in the case where a process unit is formed into a cartridge, in many cases, a photoconductive body 11, a cleaner, a waste toner box (equivalent to a waste toner storage part, waste toner storage means) 27 and the like are integrally constructed, and in some cases, a developing device 14 and a waste toner box 27 are also integrally constructed (see FIG. 2(*b*)), and the whole is replaced collectively. Incidentally, although the structure in which the cleaning blade and the waste toner box are integrally constructed and can be detached from the photoconductive body is also proposed as described above, there is a problem of toner spillage and the like.

In the embodiment of the invention, for example, as a cleaning member (equivalent to cleaning means), the brush roller 31 or an elastic roller (33A of FIG. 7) is brought into contact with the photoconductive body 11. FIG. 1(*a*) shows an example in which the cleaning means is the brush roller, and the brush is made of, for example, nylon or rayon, its resistance is 10e4 to 10e10Ω, its thickness is 0.5 to 6 denier, a roller diameter is 10 to 20 mm, and a speed difference is provided relative to the photoconductive body and rotation driving is performed. In experiments, the thickness was 2 denier, the diameter was 16 mm, the material was nylon, and the resistance was 1×10e7Ω, and while it was rotated at a double speed relative to the photoconductive body 11 in the With direction, +500 v was applied.

Further, the conductive roller 32 of Φ14 as a toner removal part (equivalent to toner removal means) from the cleaning means was brought into contact with the brush roller 31, was rotated at a half speed relative to the brush in the With direction, and +700 v was applied. Further, the simple cleaning blade 33 is brought into contact with the conductive roller 32, and by that, the reverse transfer toner was removed from the conductive roller 32, and was deposited in the waste toner box 34. It is preferable that the conductive roll 32 is provided with a surface layer.

As the surface layer, a Teflon or fluorine coat material with a good release property is effective, and the thickness is preferably about 3 to 300 μm. The resistance of the brush in a range of about 1×10e4 to 10e10Ω can be used, and when it is 10e4Ω or lower, most of the transfer residual toner captured in the brush is inverted in polarity by charge injection or the like before reaching the contact portion with the conductive roller 32, and consequently, it is not moved to the conductive roller 32, and can again adhere to the photoconductive body. Besides, when it is 10e10Ω or higher, unless the applied bias to the brush roller 31 is made +1000 v or higher, the effect is small and the efficiency becomes low.

In this embodiment, as shown in FIG. 1(*b*), the brush roller 31 as the cleaning means, the conductive roller 32 as the removal means, the cleaning blade 33, and the waste toner box 34 to store the waste toner finally scraped by the cleaning blade 33 are integrally constructed, which form, as the cleaner unit, the structure attachable to and detachable from the photoconductive body or the main body of the image forming apparatus.

The amount of biting of the brush roller 31 into the photoconductive body 11 is applicable as long as both are in contact with each other, and about 0.1 to 2 mm is suitable, and for example, a structure is conceivable in which guide rings provided at both ends of a brush part of the brush roller 31 are brought into contact with the photoconductive body. However, since an allowable range is wide, the performance can be sufficiently obtained even when positioning is performed by a housing for supporting the photoconductive body 11 and the unit main body including the cleaning means.

In the embodiment of the invention, the largest feature is that since the portion directly attached to and detached from the photoconductive body 11 is made, for example, the brush roller 31, the toner is hard to spill at the time of detachment. However, waste toner is stored also in the brush roller 31 to a certain degree, when it is touched by hand, some waste toner spills.

Then, before the cleaner (unit) 30 is detached from the photoconductive body, when the toner stored in the brush roller 31 or the elastic roller 33A (FIG. 7) is sufficiently collected to the photoconductive body 11 and the waste toner box 34, it is possible to prevent the toner spillage from occurring.

For example, when the cleaner unit of the structure of FIG. 1 is detached from the photoconductive body, immediately before the removal, for example, based on a specified instruction relating to the removal from the user, a bias is applied to the brush to perform an operation for a specific time in a state where an image is not printed, and the toner on the brush is sufficiently removed.

Besides, the bias applied to the brush roller or the conductive roller is changed as compared with that at the time of normal image printing, and it can be efficiently removed in a short time.

The cleaner (unit) 30 side can be made to have these functions as toner leakage preventing means (function), or the image forming apparatus main body side can be made to have it.

Figure 3:
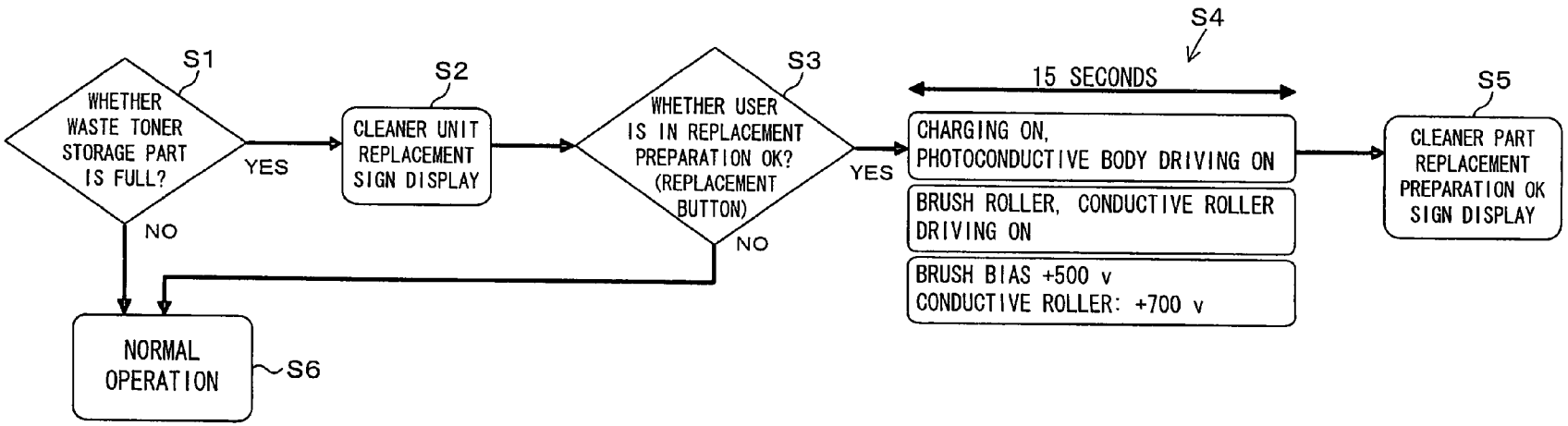
FIG. 3 is a flowchart showing an example of an operation of the embodiment of the invention.

As an example of the toner leakage preventing means, as shown in FIG. 3, when it becomes necessary to detach the cleaner part, for example, when the waste toner storage part becomes full (S1), based on a cleaner unit replacement sign (S2), when a detachment operation is performed (S3, Y), the photoconductive body, the brush and the conductive roller are automatically rotated, and for example, for 15 seconds, +500 v is applied to the brush, and +700 v is applied to the conductive roller (S4). By this operation, the minus-charged toner stored in the brush is moved to the waste toner storage part, a trace amount of minus-charged toner is moved to the photoconductive body, and the brush can be cleaned. When this operation is ended, a sign to enable the replacement of the cleaner unit is first issued (S5). Incidentally, in the case other than those, the normal operation is performed (S6).

Besides, in order to further raise the collection efficiency, when a potential difference between the conductive roller 32 and the brush roller 31 is made larger than that at the time of normal image printing, or an oscillating electric field such as AC bias is applied to the conductive roller 32, an effect is obtained.

For example, when the condition of the brush bias of +500 v for 15 seconds and the conductive roller bias of +700 v shown in FIG. 3 is changed such that the conductive roller bias is about +1000 v, the removal performance of toner from the brush is increased. Further, when an AC bias of DC+800v+ACpp1500v and about 500 Hz is applied to the conductive roller, the collection efficiency is further increased.

In the embodiment of the invention, although the cleaner (unit) 30 is constructed to be attachable to and detachable from the image forming apparatus, at this time, when the frequency of the replacement operation of the photoconductive body 11, the charger 12 and the developing device 14 is very small, the user can achieve the maintenance of the image forming apparatus by replacing only the cleaner 30 and the waste toner tank (discharge toner containing part from the developing device).

For that purpose, for example, with respect to the photoconductive body 11, it is preferable to use one using A-Si.

Besides, also in the developing device 14, in the two-component development including the toner and carrier, periodic replacement of the developer is generally inevitable, and it is appropriate to adopt a system to automatically replace the carrier little by little without detaching the developing device from the image forming apparatus.

Figure 4:
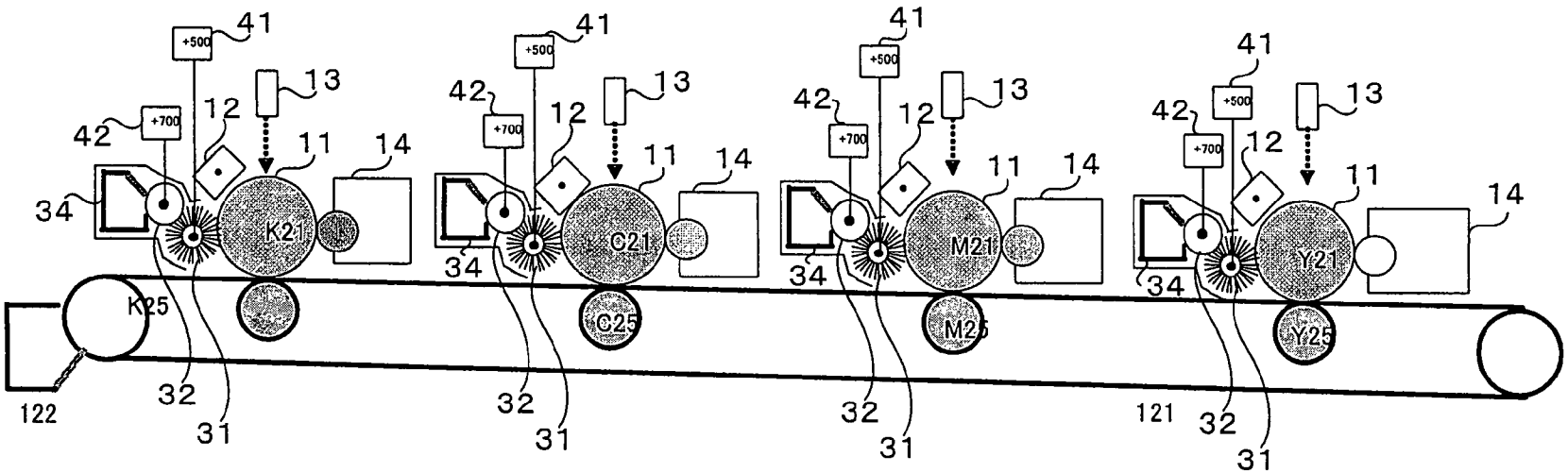
FIG. 4 is a schematic view showing a tandem structure of an image forming apparatus.

Especially, in the case of a tandem type color machine as shown in FIG. 4, a cleaner unit at an upstream station and a developing device at a downstream station tend to interfere with each other. When the developing device is miniaturized in a normal developing system, the amount of developer is decreased, and the replacement cycle becomes short. However, when a small amount replacement system is adopted in which it is small and a replacement operation of developer is unnecessary, the developing device is maintenanceless and can be miniaturized, and therefore, since the space of the waste toner box can be made large to the utmost, the space of the waste toner storage part (waste toner box) is made large, and a synergistic effect that the replacement cycle of the cleaner unit is prolonged and it becomes unnecessary to replace the developing device can be expected.

Figure 5:
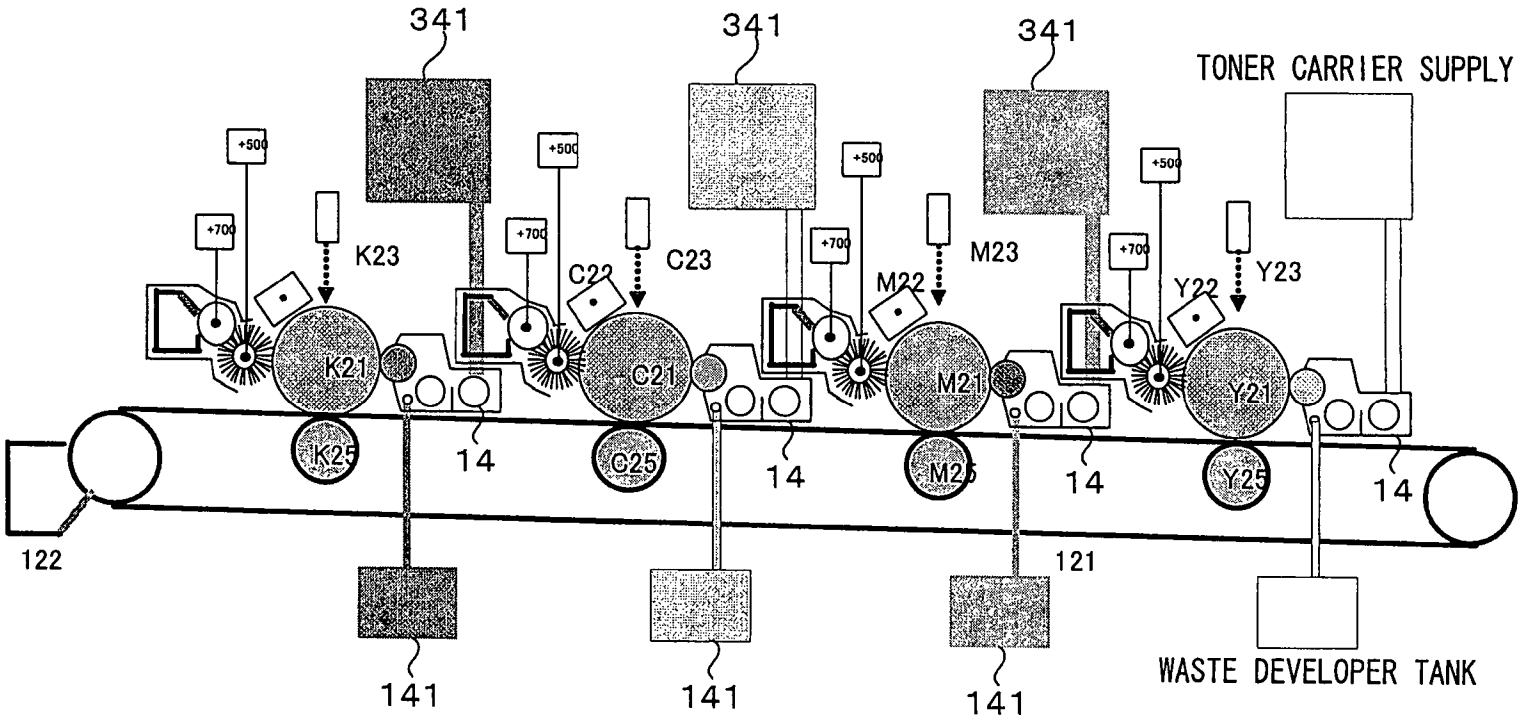
FIG. 5 is a schematic view showing a structure of the image forming apparatus in which a cleaner unit and a developing device are combined to improve efficiency of space in the tandem structure shown in FIG. 4.
Figure 6B:
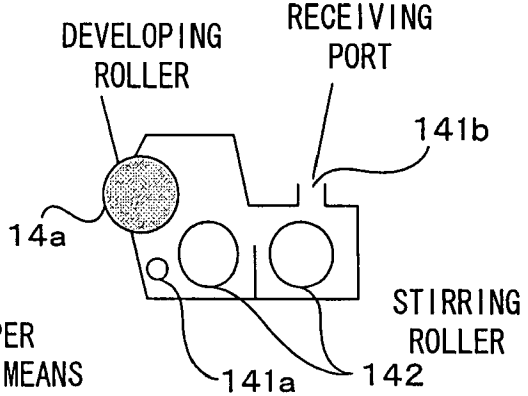
FIG. 6(*a*) is a plan view showing a developing device in the embodiment of the invention.
Figure 6A:
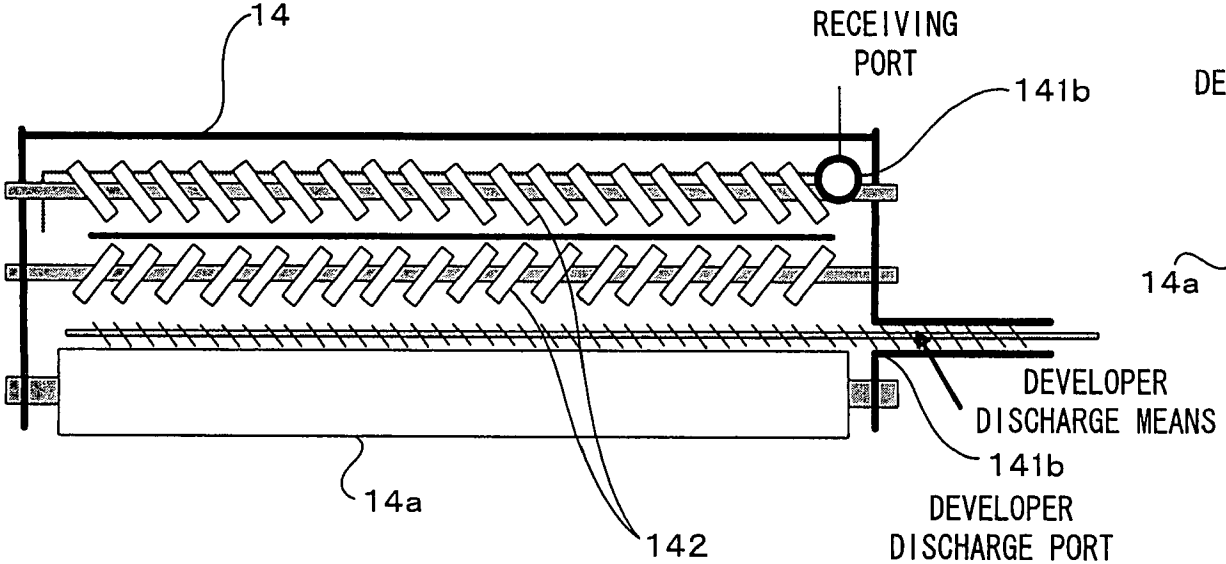

FIG. 5 shows a whole structure of a tandem system image forming apparatus, and FIG. 6 shows an example of a developing device. In FIG. 5, 141 denotes a waste toner tank, and 341 denotes an enlarged waste toner box.

As shown in FIG. 5 and FIG. 6, a developing device 14 includes a discharge port 141*a* for developer, and the developer is gradually discharged therefrom and is sent to the waste toner tank 141.

With respect to the control of the discharge amount, the discharge operation may be controlled by, for example, the rotation of an auger 142 shown in FIG. 6 as the discharge means for only the developer, or the so-called overflow system may be used in which when the amount of developer in the developing device 14 is increased and comes to have a specific height or more, it overflows and is discharged.

With respect to the supply of the developer, a small amount of carrier, together with the toner, is previously mixed in a not-shown toner tank, and as the toner is consumed, the carrier, together with the toner, may be gradually supplied from a receiving port 141*b*, or the toner and the carrier are separately controlled and may be inputted to the developing device.

In any event, by using the developing device as stated above, the replacement operation of the developer by attaching and detaching the developing device to and from the apparatus becomes unnecessary. Since the mechanical life of the developing device in the two-component development is about 300,000 sheets to 2,000,000 sheets and is very long, it can be said that an apparent replacement operation of the developing device is eliminated for the user.

Figure 9:
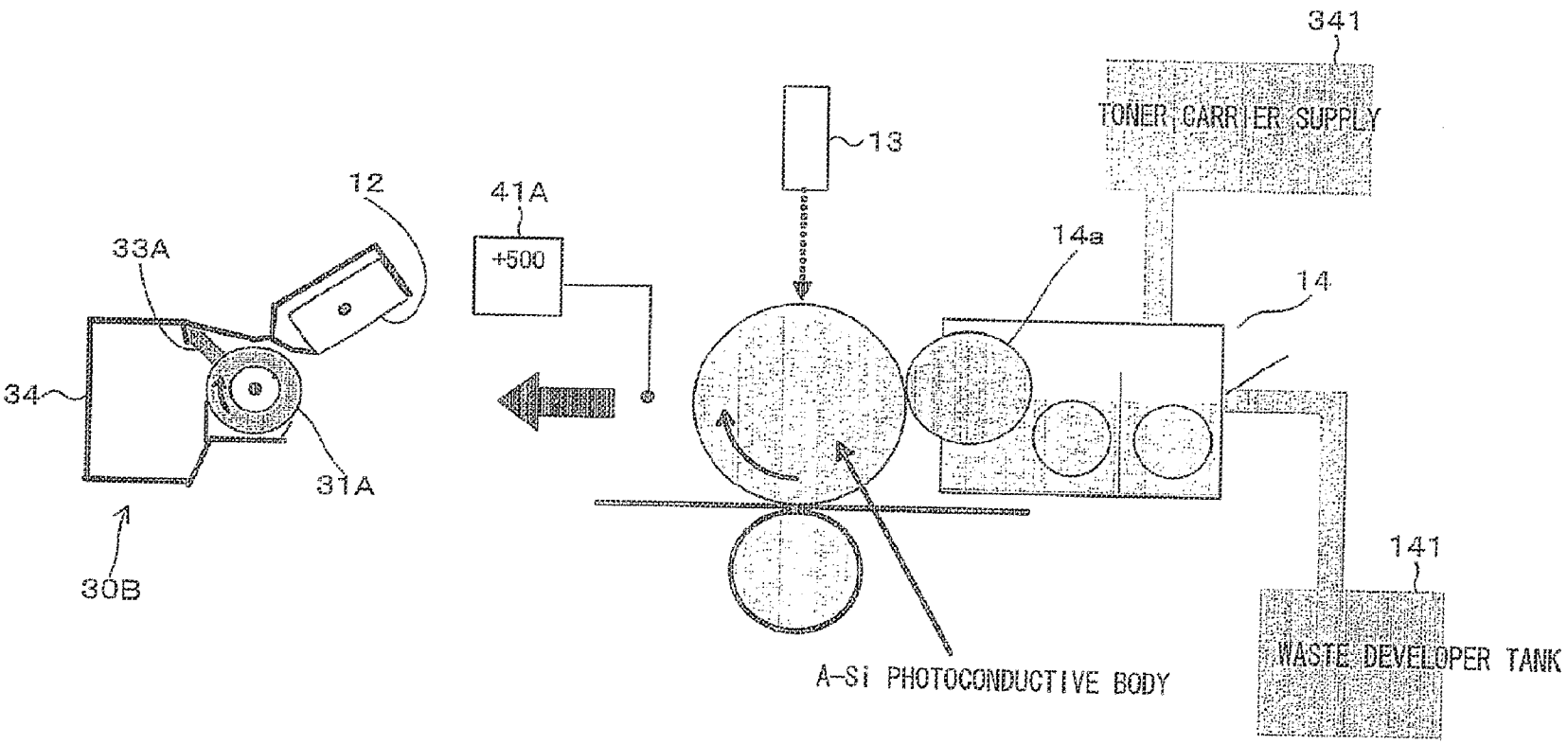
FIG. 9 is a view showing an example in which a cleaner unit and a charger are made to have an integral structure and replaceable.

In this way, it becomes possible to seldom detach the photoconductive body and the developing device from the image forming apparatus. Further, for example, as shown in FIG. 9, the charger 12 is integrated with a cleaner unit 30B, and by that, the user has only to perform the maintenance of only the replacement of the toner tank and the cleaner unit (cartridge including the charger).

Figure 7:
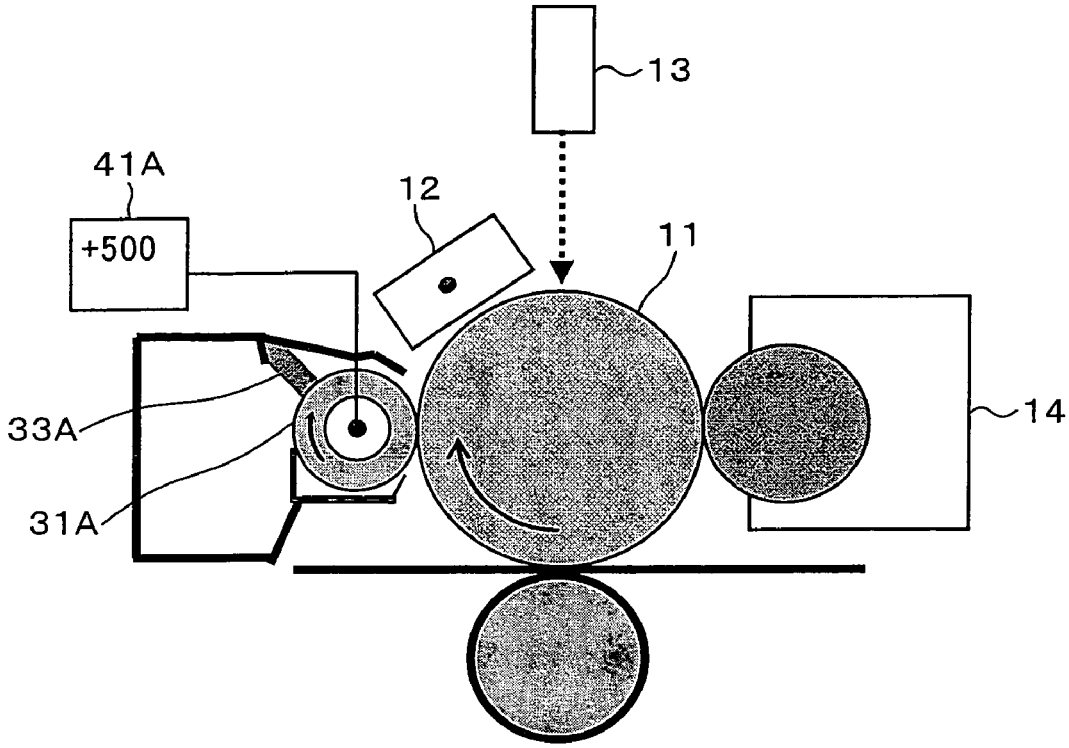
FIG. 7 is a side view showing another example of cleaning means.
Figure 8:
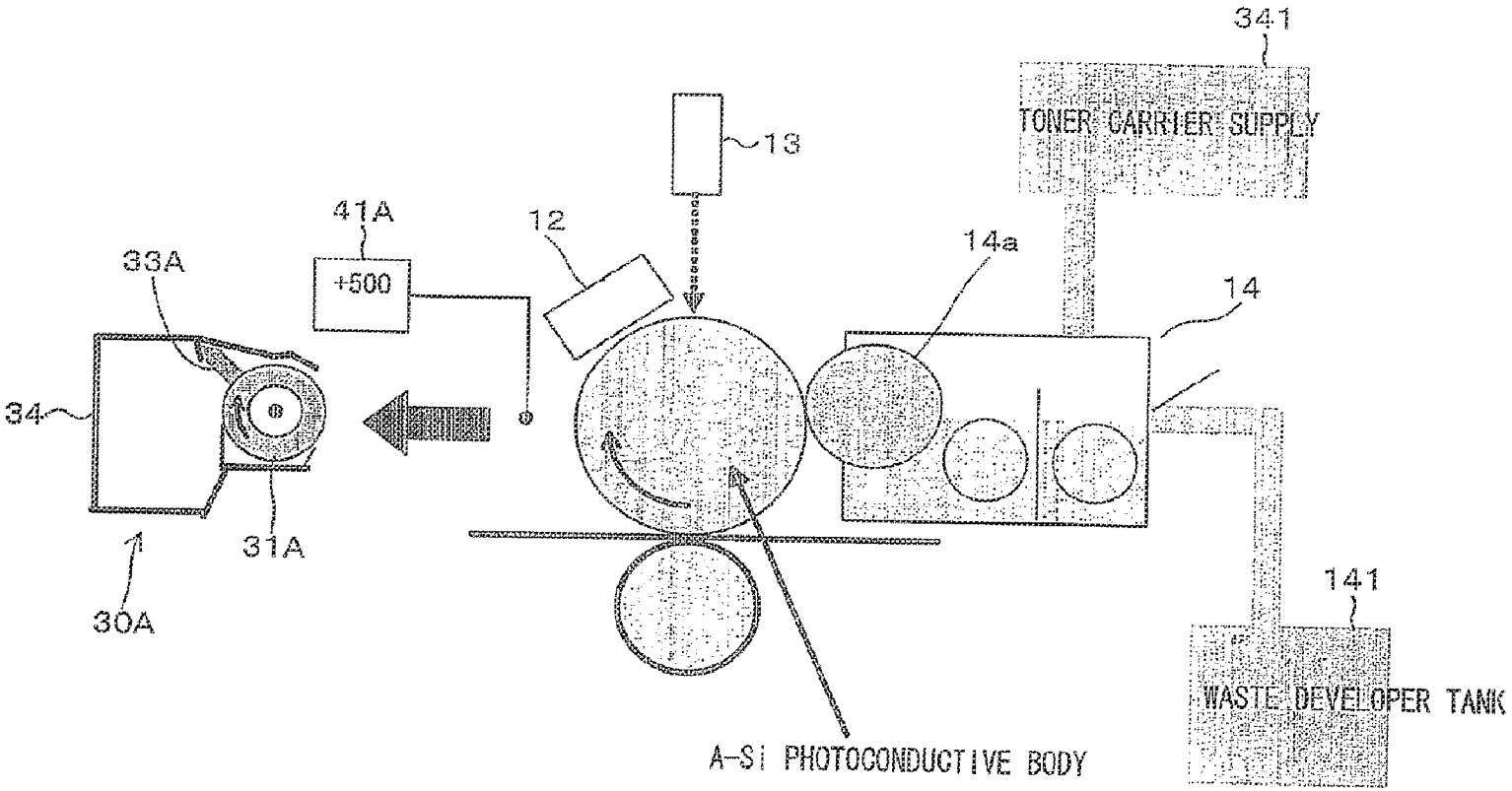
FIG. 8 is a view showing an example in which only a cleaner unit is replaced.

FIG. 7 and FIG. 8 show a cleaner (unit) 30A in which cleaning means is made an elastic roller 31A instead of the brush roller 31. FIG. 8 is a view showing the detachment thereof. Since the cleaning means is brought into contact with the photoconductive body 11, it is necessary that its surface is soft to a certain degree. For example, although a sponge roller or a rubber roller can be named, in the case of the sponge roller, similarly to the case where the brush roller is used, a conductive roller or the like to remove toner from the sponge roller is required. Although that is sufficiently effective, in the case where the structure is further simplified, the structure is made such that a fluorine or Teflon surface layer is provided on the sponge roller or the rubber roller to facilitate blade cleaning, and the structure can be made such that a blade 33A is brought into direct contact with these, and the toner on the cleaning means (elastic roller 31A) is scraped.

In FIG. 7, the elastic roller 31A is constructed such that a fluorine-based surface layer is provided on an NBR conductive rubber of JIS-A hardness of 60°, it is brought into contact with the photoconductive body 11, and a bias of +500 v is applied. By this, the residual transfer toner with a minus polarity is attached to the elastic roller 31A, is scraped by an urethane blade 33A brought into contact with the elastic roller 31A, and is stored in the waste toner storage part (box) 34.

In the embodiment of the invention, the cleaning part constituting the cleaner and the waste toner storage part (box) 34 are integrally constructed and are made to be capable of being detached from the photoconductive body, and since the integral structure including the waste toner storage part 34 is formed, transport means for sending to the waste toner box and the discharge port become unnecessary, and the replacement is facilitated. However, as a disadvantage, in the case where the life as the cleaning means can also be made long, the waste toner is endlessly deposited in the waste toner storage part 34, and the waste toner storage part must be enlarged by the amount. As a result, there arises a possibility that the replacement cycle of the cleaner unit is determined by the capacity of the waste toner storage part, not the life of the cleaning means.

It is important that the "volume" of waste toner stored in the toner storage unit 34 must be small, and following conditions are important for that.

(1) Transfer efficiency is high.

(2) When toner is deposited, it does not become bulky.

As the structure to satisfy these requirements, for example, when the contact transfer system is adopted, as compared with the corona transfer or the like, the transfer efficiency becomes high. Further, since the polarity of the residual transfer toner is hard to vary, there is a merit that the occurrence of reversely-charged toner is small and it becomes advantageous also in bias cleaning.

Besides, in recent years, in order to improve picture quality, a small particle size toner of a particle size of 6 μm or less is often used, however, in the small particle size toner, blade cleaning is generally hard to perform. However, bias cleaning using a brush is possible, and further, when the particle size is small, even in the same amount of toner, the "volume" becomes small, and there is an effect that the waste toner storage part can be made smaller. Further, when the toner is a spherical toner, the "volume" of waste toner becomes small, and accordingly, it is advantageous. As stated above, in the embodiment of the invention, when the contact transfer system, the small particle size toner, and the spherical toner are combined, the synergistic effect can be expected.

In the present specification, although only the cleaner of the photoconductive body has been set forth, no limitation is made to the cleaner of the photoconductive body in respect of effects. For example, also in a cleaner of an intermediate transfer belt, a similar effect can be expected. Besides, also in a cleaner of a transfer belt, the same can be said.

For example, in the cleaner of the transfer belt, when roller-shaped cleaning means, toner removal means, and waste toner storage part are integrally constructed into a unit structure, and it is made the structure easily attachable to and detachable from the transfer belt, it becomes possible for the user to replace the belt cleaner, whose life is short relative to the belt, together with the waste toner. Here, toner spillage at the time of detachment can be prevented by the roller-shaped cleaning means, and further, before the unit is detached, when electric field is applied separately from the printing operation to remove toner deposited on the cleaning means, even after the cleaner unit is detached, it is possible to prevent the user from becoming dirty with toner.

Besides, also in such a state, the volume of toner is important, and it is needless to say that the spherical toner is advantageous.

(Verification Experiment for the Effect of the Embodiment)

The cleaner unit using the brush roller as shown in FIG. 1 was used, and a character chart of a printing area ratio of 20% in A4 size was continuously printed. The bias applied to the brush was +500 v, and +700 v was applied to the conductive roller. After 10,000 sheets were continuously printed, the cleaner unit was detached from the photoconductive body, and it was visually checked whether toner spillage occurred from the cleaner unit at that time.

Further, a mending tape was stuck on the brush roller part of the detached cleaner unit, and the toner attached to the brush was extracted. The tape was stuck on a white sheet, reflection density was measured by a Macbeth densitometer, and the amount of toner attached to the brush was examined.

FIG. 10 shows experimental results.

First, as experiment (1), the cleaner unit was constructed by using a cleaner of a conventional cleaning blade, and when it was detached from the photoconductive body, a large mount of toner spillage occurred. On the other hand, in the case (experiment (2)) where the embodiment of the invention was applied, the cleaning means was changed to the brush roller, the toner removal means was made the conductive roller, and the blade and the waste toner storage part were integrally constructed into the cleaner unit, toner spillage at the time of detachment did not occur.

At this time, the density at the time when the brush was taped was 0.38, and when the brush was touched by hand, the hand became slightly dirty with toner.

Subsequently, as experiment (3), after 10,000 sheets were printed, before the cleaner unit was detached from the photoconductive body, when the bias similar to that at the time of the printing operation was applied to the brush roller and the conductive roller for 15 seconds, the density of toner deposited on the brush was lowered to 0.3. Even when it was touched by hand, the level of stain was slightly improved.

Subsequently, as experiment (4), when the bias applied for 15 seconds was changed to +700 v for the brush roller and +1000 v for the conductive roller, the toner density of the brush was lowered to 0.2, and even if the brush was touched by hand, the hand hardly became dirty.

Further, in experiment (5), the voltage applied to the brush roller remained +700v, and when a voltage was superimposed on the conductive roller, the toner density of the brush can be further lowered to 0.18.

Besides, in experiment (6), the conductive sponge roller was used as the cleaning means, and when the structure other than that was made the same as experiment (2), toner spillage at the time of detachment did not occur, the toner density of the sponge roller was 0.4, and when it was touched by hand, the hand became slightly dirty.

Besides, results in experiments (7) to (9) using a cleaner unit were indicated in which +500 v was applied to, as cleaning means, an elastic roller provided with a surface layer, and an urethane blade was further brought into contact with the elastic roller.

In experiment (7), after 10,000 sheets were printed, when it was simply detached from the photoconductive body, toner spillage at the time of detachment did not occur, the toner density at the time when the elastic roller was taped was 0.3, and when it was touched by hand, the hand became slightly dirty.

In experiment (8), when +500 v was applied to the elastic roller for 15 seconds immediately before detachment, the toner density of the elastic roller became 0.2, and the toner stain was reduced. Besides, in experiment 9, when the applied bias to the elastic roller for 15 seconds was made +700 v, not +500 v, the density of toner stain became 0.15, and even if it was touched by hand, the hand hardly became dirty with toner.

As stated above, when the elastic roller having the surface layer is used as the cleaning means, the toner stain at the time of detachment can be reduced more than that at the time when the brush is used. Besides, as the cleaner unit, the durability can be made high in the case where the brush is used, and the unit structure can also be simplified.

FIG. 11 shows durability evaluation results.

A continuous printing test of a printing ratio of 5% was performed in a case where the brush was used as the cleaning means, and in a case where the elastic roller with the surface layer was used, and the number of sheets printed before defective cleaning occurred was examined, and both were set so that the waste toner storage part did not become full. As a result, in the case where the elastic roller was used, the defective cleaning occurred at about 60,000 sheets, while in the case where the brush roller was used, it did not occur until 150,000 sheets. This is because it is conceivable that in the elastic roller provided with the surface layer, since the roller is deformed and is further rubbed with the blade, the surface layer is easily damaged, while in the case where the brush is used, the toner is once transferred from the brush to the conductive roller, and is scraped from the conductive roller by the blade, and accordingly, it is hardly necessary to deform the conductive roller, and both the roller surface and the blade are hard to damage.

Subsequently, with respect to a case where the transfer roller was used in the transfer system (contact transfer), a case where corona transfer is used, and a case where the particle size and spherical degree of toner are changed, an experiment was performed on the amount of waste toner stored in the waste toner storage part. A sponge roller was used as the transfer roller, and a corotron charger was used for the corona transfer. The toner was formed by mainly using polyester resin, was prepared by a grinding system, was divided by a classifier, and an average particle size was changed. With respect to the spherical degree of toner, after the toner was prepared by the grinding system, the circular degree was adjusted by performing a heat treatment, the evaluation of the circular degree was performed by LUZEX AP made by NIRECO CORPORATION, and measurement was made for both SF-1 and SF-2.

The continuous printing test was performed with an image of a printing ratio of 20% in A4 size. Since the printing ratio is high, the amount of waste toner is naturally large. As the evaluation, the number of sheets printed before the waste toner storage part became full was compared.

Figure 12:
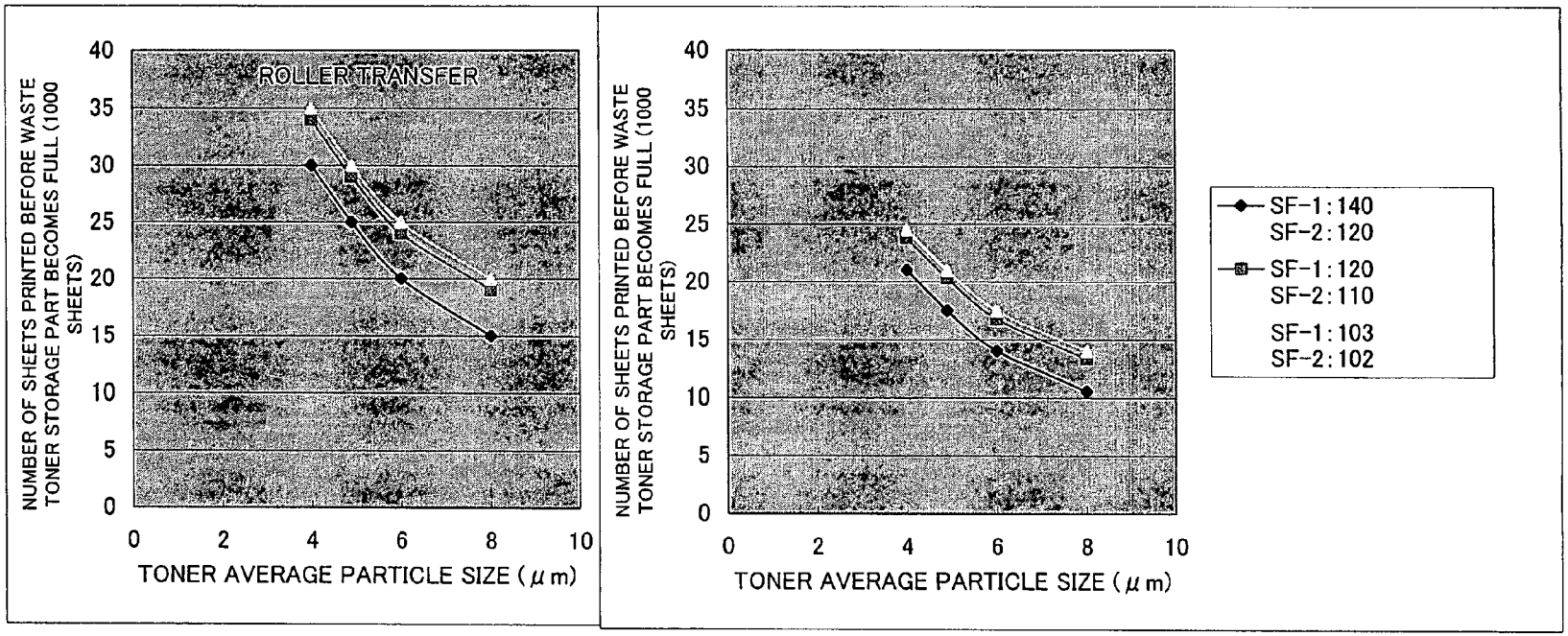
FIG. 12 is a view showing effects of a transfer system, a toner particle size, and a toner spherical degree.

FIG. 12 shows experimental results.

It is understood that when the contact transfer is used, the "volume" of waste toner can be decreased, and as the toner particle size becomes small, and the toner approaches the spherical shape, the "volume" of waste toner can be decreased.

FIG. 13 shows results obtained when the toner of an average particle size of 6 μm, spherical degree SF-A: 120 and SF-2: 110 was used, and the continuous printing test of a printing ratio of 5% was performed by the contact transfer using the transfer roller. The structure of (combination 1) is a combination of a conventional two-component developing device, a normal organic photoconductive body, a cleaner unit using a brush roller of the embodiment of the invention, and a charging charger. Especially, when consideration is given to a color machine, the photoconductive body must be made small in diameter, and accordingly, it was made Φ30, the developing device was also miniaturized, and the developer capacity was made 200 g. As a result of the test, after about 40,000 sheets were printed, the surface of the photoconductive body was shaved and became rough, and the picture quality reached an NG level.

Then, when the photoconductive body was replaced and the test was continued, at the time of 50,000 sheets in total, fogging of the developing device next reached the NG level, and the developer was replaced. A disadvantage occurred in the charging charger and the cleaner unit of the embodiment of the invention when about 100,000 sheets were printed in total.

That is, it is understood that when the conventional developing device and the organic photoconductive body are combined, especially in the case of miniaturization, the maintenance cycle as the image forming apparatus can not be prolonged, and even if the cleaner unit can be made replaceable from the photoconductive body, various things must be frequently replaced.

Then, as indicated by the (combination 2), the structure was made such that the photoconductive body was made of A-Si, and a developer discharge port was provided in the developing device, so that the developer was gradually replaced. As a result, with respect to the photoconductive body and the development, even when 300,000 sheets were printed in total, a defect did not occur on an image, and the maintenance cycle as the apparatus could be prolonged to 100,000 sheets of the cleaner unit and the charging charger. Further, like the (combination 3), when the cleaner unit and the charging charger are integrally constructed and are made to be capable of being detached from the photoconductive body, the one unit has only to be replaced at a maintenance cycle of 100,000 sheets. Further, the (combination 4) indicates a case where most of the cleaner unit is made of resin.

Specifically, a gear to drive the brush or the conductive roller was constructed of polystyrene resin, and conductive plastic was used for a shaft, a bush, an electrode and the like. As a result, as was expected, the durability as the cleaner was degraded as compared with the related art, and defective cleaning occurred at about 80,000 sheets. However, even if the maintenance cycle is changed from 100,000 to 80,000 sheets, when a reduction in cost can be made, and an advantage is obtained in discarding and recycling, the adoption has a sufficient meaning. Further, since the replacement cycle as the cleaner unit greatly depends on the "volume" of waste toner and the capacity of the waste toner storage part of the unit, for example, in the case where consideration is given to miniaturization of the whole apparatus in a color tandem apparatus or the like, even if the durability of the cleaning part itself is improved, when the waste toner becomes full, the level is NG, and accordingly, it can be said that a great effect is obtained when the unit is made of resin.

(Effects of the Embodiment of the Invention)

According to the embodiment of the invention described in detail, in the cleaner part constructed to be attachable to and detachable from the photoconductive body, the cleaning means is made the elastic roller or the brush roller, so that the occurrence of toner spillage is eliminated almost completely, and further, since these members do not require the contact accuracy as compared with the blade cleaner, the fear of defective cleaning disappears.

Besides, in recent years, with reduction in particle size of toner and improvement in function, the transfer efficiency is greatly improved, and therefore, the amount of transfer residual toner on the photoconductive body is significantly decreased, and the amount of waste toner is also significantly decreased. Then, the cleaning means and the waste toner tank are integrally constructed into the cleaner unit.

By doing so, a waste toner transport passage from a cleaner part to a waste toner tank as in the related art becomes unnecessary, and a discharge port is eliminated from the cleaner part, and therefore, when the cleaner unit is detached, the toner spillage from a portion other than the cleaning means can be completely eliminated.

Then, the photoconductive body having a long life is seldom replaced, and only the cleaner unit having a relatively short life is replaced.

By doing so, the toner spillage at the time of attachment or detachment can be prevented almost completely, and further, since the position accuracy at the time of replacement is not required very much, the user can easily replace the cleaner unit as if the waste toner tank is replaced. Since the toner tank is also integrated with the cleaner part, by the replacement of only the toner cartridge, the waste toner and the cleaner can be replaced at the same time. Further, when most of the cleaner unit is made of resin, the efficiency at the time of discarding or recycling can be improved.

Incidentally, although it is disclosed in, for example, patent document 3 (JP-A-2004-279681) that a drive part and the like of a cartridge are made of resin in view of recycling, the structure is not such that the cleaner unit is individually detached. Especially, when the developing part and the like are also integrated, the developing roller is required to have high accuracy, and it is difficult that the shaft is also formed by using resin, and therefore, an operation of detaching the developing roller is required at the time of recycling, and in the case where the photoconductive body is also integrated, an operation of detaching the photoconductive body is required. So to speak, the conventional recycling assumes that the unit is decomposed, and is merely a system in which among parts detached after decomposition, a usable one is again used as it is.

In the embodiment of the invention, in the cleaner unit, in the case where the roller shaft, the drive part and the like are made of resin, as described above, the brush roller does not require relatively high accuracy, and it is assumed that the brush roller is replaced when the waste toner becomes full, and therefore, high durability is unnecessary, and it can be said that the formation using resin is easy as a whole.

Since the cleaner unit is singly detached at the user level, nothing is detached thereafter, it is melted as resin and is recycled or can be discarded, and a superfluous operation such as decomposition at the time of recycling is eliminated.

What is claimed is:

1. A cleaner unit of an image forming apparatus, comprising:

a cleaning member that is brought into contact with a toner bearing body in order to collect toner from the toner bearing body bearing the toner;

a toner removal member configured to remove the toner from the cleaning member;

a waste toner storage part configured to store the removed toner, and a toner leakage preventing mechanism to prevent toner from leaking from the unit to outside in a case when the unit is attached to or detached from the toner bearing body, wherein the cleaning member, the toner removal member and the waste toner storage part are integrally constructed into a unit structure, and the unit is constructed to be attachable to and detachable from the toner bearing body or a main body of the image forming apparatus, the toner leakage preventing mechanism actuates at least the cleaning member and the toner removal member, and performs an operation to move the removed toner to the toner bearing body or the waste toner storage part, and the operation of the toner leakage preventing mechanism is performed based on a cleaner unit replacement instruction before the unit is detached from the toner bearing body.

2. The cleaner unit of the image forming apparatus according to claim 1, wherein the toner leakage preventing mechanism applies a bias different from that at a time of image printing to at least one of the toner bearing body, the cleaning member, and the toner removal member and causes the operation to be performed.

3. The cleaner unit of the image forming apparatus according to claim 1, wherein the cleaning member is a roller-shaped member to which a bias is applied.

4. The cleaner unit of the image forming apparatus according to claim 1, wherein the cleaning member is a brush-shaped member to which a bias is applied.

5. The cleaner unit of the image forming apparatus according to claim 1, wherein the toner bearing body is a photoconductive body, and the toner collected by the cleaning member is transfer residual toner remaining on the photoconductive body after a toner image formed on the photoconductive body is transferred onto a transfer-receiving member.

6. The cleaner unit of the image forming apparatus according to claim 5, wherein the photoconductive body is constructed of a material including A-Si.

7. The cleaner unit of the image forming apparatus according to claim 1, wherein the cleaning member is brought into contact with the toner bearing body through a shaft, and the shaft is made of resin.

8. The cleaner unit of the image forming apparatus according to claim 1, wherein a transfer system from the image bearing body to a transfer-receiving member adopts a contact transfer system.

9. A cleaner unit of an image forming apparatus, comprising:

cleaning means brought into contact with toner bearing means and for collecting toner from the toner bearing means bearing the toner;

toner removal means for removing the toner from the cleaning means;

waste toner storage means for storing the removed toner;

toner leakage preventing means for preventing toner from leaking from the unit to outside in a case when the unit is attached to or detached from the toner bearing means, wherein the cleaning means, the toner removal means and the waste toner storage means are integrally constructed into a unit structure, and the unit is constructed to be attachable to and detachable from the toner bearing means or a main body of the image forming apparatus, an operation of the toner leakage preventing means is performed based on a cleaner unit replacement instruction before the unit is detached from the toner bearing means.

* * * * *